United States Patent [19]

Yoshimi et al.

[11] Patent Number: 4,860,506

[45] Date of Patent: Aug. 29, 1989

[54] FLOOR PANEL FOR FLOATING FLOOR

[75] Inventors: Satoshi Yoshimi; Youichiro Koga, both of Osaka, Japan

[73] Assignee: Daiken Trade & Industry Co., Ltd., Toyama, Japan

[21] Appl. No.: 163,986

[22] Filed: Mar. 4, 1988

[30] Foreign Application Priority Data

Mar. 6, 1987 [JP] Japan ..... 62-51438

[51] Int. Cl.[4] ..... E04B 1/82

[52] U.S. Cl. ..... 52/144; 52/180; 52/807

[58] Field of Search ..... 52/807, 815, 479, 480, 52/144, 180

[56] References Cited

U.S. PATENT DOCUMENTS

| | | | |
|---|---|---|---|
| D. 183,574 | 9/1958 | Liskey, Jr. | 52/180 X |
| 1,554,179 | 9/1925 | Trader | 52/144 X |
| 1,804,884 | 5/1931 | Mazer | 52/144 X |
| 2,002,510 | 5/1935 | Rosenblatt | 52/144 |
| 2,931,213 | 4/1960 | Maccaferri | 52/144 |
| 2,954,838 | 10/1960 | Nuorivaara | 52/144 X |
| 2,967,583 | 1/1961 | Jack | 52/144 |
| 3,180,448 | 4/1965 | Gary, Jr. et al. | 52/144 X |
| 4,226,064 | 10/1980 | Kraayenhof | 52/180 |
| 4,319,520 | 3/1982 | Lanting et al. | 52/815 X |

FOREIGN PATENT DOCUMENTS

| | | | |
|---|---|---|---|
| 376633 | 5/1964 | Switzerland | 52/807 |

*Primary Examiner*—Carl D. Friedman

*Attorney, Agent, or Firm*—Scully, Scott, Murphy & Presser

[57] ABSTRACT

A floor panel for floating floor of the kind comprising floor panels elastically supported by buffer members laid on a floor framing is characterized in that the floor panel is provided with a plurality of through holes, and supporting means integrally united to its underside at proper intervals. The through holes are uniformly distributed over the floor panel and so designed that they have an upper opening diameter of 5 to 20 mm and an opening area ratio to the upper surface area of the panel within the range of from 0.1 to 20% to prevent the air between the floor panel and the buffer members from compression and expansion.

4 Claims, 5 Drawing Sheets

FLOOR PANEL FOR FLOATING FLOOR

FIELD OF THE INVENTION

This invention relates to a floor panel for floating floors and, more particularly, to a floor panel with high impact sound insulating performances for use in a floating floor construction in multistoried apartments or buildings to reduce transmission of floor impact sounds to the room located directly below.

BACKGROUND OF THE INVENTION

In multistoried apartments or buildings, transmission of floor impact sounds from the upper stories to the room located directly below causes troubles frequently. Such floor impact sounds are generally divided into two groups, i.e., light-weight floor impact sounds produced by occupant activity such as walking and, heavy floor impact sounds produced by sharp transient type impulses such as those caused by falling objects or jump-off of a child. The former, light-weight floor impact sounds can be reduced with ease by constituting a finish floor with soft or flexible finish floorings such as carpets since such finish floorings absorb the light-weight impacts effectively.

It is, however, very difficult with such finish floorings to reduce the heavy floor impact sounds effectively. The heavy impact forces are too large for the soft finish floorings and are scarcely absorbed by the finish floor. Thus, the heavy impact forces are directly transmitted to the concrete slab through the floor panels, thereby causing vibration of the concrete slab at low frequencies, which in turn causes production of heavy floor impact sounds.

As a means for reducing the transmission of impact forces to the concrete slab, there has been known a floating floor constructed by laying buffer members such as glass wool mats on a floor slab such as concrete slabs, arranging floor joists on the buffer members at proper intervals, laying floor panels on the floor joists to form a floating floor, and then covering the same with finish floorings. In such a floating floor, a heavy impact force applied to a point of the finish floor is distributed over several floor joists through the floor panel and then transmitted to the buffer members. The transmitted force is then absorbed and weakened to some degree by deformation of the buffer members, thus making it possible to reduce the forces directly acting on the concrete slab.

However, it is impossible with the above floating floor to obtain satisfactory sound insulating characteristics. Since the floating floor has a space formed between the floor panels and buffer members, the floor panels are easy to produce flexural deformation by the heavy impact. For this reason, the heavy floor impact produces a large flexural vibration of the floor panels, which is easy to propagate through the floor slab to the room located directly below. Also, the flexural deformation of the floor panel causes spontaneous compression of the air under the floor panels, resulting in increase in air pressure. The pressure of the compressed air acts alternately on the underside of the floor panel and the upperside of the buffer members, and causes vibration of the floor slab. Furthermore, if any heavy impact force is applied to one of the floor panels, its flexural vibration is propagated to the other floor panels through the floor joists since the floor panels are mounted in parallel on the assembled floor joists. In addition, since the individual floor joists are required to be arranged on the soft buffer members, it is difficult with the prior art to keep the floor joists in their fixed positions during construction work. Thus, the use of joists makes it difficult to improve efficiency of work.

SUMMARY OF THE INVENTION

It is therefore an object of the present invention to provide a floor panel for floating floor which overcomes the aforesaid disadvantages and makes it possible to achieve considerable reduction in the transmission of floor impact sounds to the room located directly below.

Another object of the present invention is to provide a floor panel for floating floor in multistoried apartments or buildings that rpevents the air under the floor panel from increase in pressure, thereby reducing the air pressure acting on the floor framings including buffer members and floor slab to reduce transmission of floor impact sounds to the room located directly below.

Still another object of the present invention is to provide a floor panel which makes it possible to construct a floating floor without use of floor joists.

These and other objects of the present invention are achieved by providing a floor panel for a floating floor of the kind comprising floor panels elastically supported by buffer members laid on a floor slab, characterized in that said floor panel is provided with a plurality of through holes and supporting means integrally united to its underside at proper intervals, said through holes having an upper opening diameter of 5 to 20 mm and being uniformly distributed over the floor panel such that an opening area ratio of said holes to the upper surface area of the panel being within the range of from 0.1 to 20%.

In one preferred embodiment, the floor panel is composed of a solid board provided with a plurality of through holes perpendicular to its upper and under faces.

In another preferred embodiment, the floor panel is made of a hollow board comprising a pair of face panels spaced by sash bars, and the holes are formed in said face panels such that holes of the upper face plate are respectively aligned with those of the lower face plate.

It is preferred that the floor panel has stepped portions formed along its peripheries, on which connecting members are mounted to form a flat floor.

As a material for the floor panels, there may be used wooden panels, inorganic panels, composite wooden panels reinforced with a material having a high tensile strength such as, for example, iron plates, fiber glass reinforced plastic plates and the like to improve the flexural rigidity. The wooden panels include, without being limited to, plywoods, laminated veneer lumber (LVL), particle boards, wooden cement boards and the like. The inorganic panels include, without being limited to, reinforced mortar boards, concrete panels, glass fiber reinforced cement (GRC) panels, cement panels, and the like. These panels may be used in the form of a solid panel or a hollow panel.

In the floating floor comprising the floor panels of the present invention, if any impact is applied to the finish floor, the impact force is distributed over the buffer members through the floor panel and supporting means provided on its underside, thus making it possible to prevent the buffer member from local transmission of the impact force. At the same time, the floor panel is spontaneously deformed by the impact force, but the air under the floor panel is smoothly released through the through holes to the upper side of the floor panels. The floor panel is then bent in the reverse direction by the reaction, but the air in the upper room flows into the underside of the floor panel through the holes. According to the present invention, the air under the floor panels is prevented from compression and expansion, thus making it possible to achieve considerable decrease in transmission of the floor impact sounds to the room located directly below.

Since the supporting means are integrally formed on the underside of the floor panel and serve as floor joists, there is no need to use separate floor joists, thus making it possible to improve efficiency of work.

BRIEF DESCSRIPTION OF THE DRAWINGS

The invention will be further apparent from the following description taken in conjunction with the accompanying drawings which show, by way of example only, several preferred embodiments of the present invention.

DETAILED DESCRIPTION OF A PREFERRED EMBODIMENT OF THE INVENTION

Figure 1:
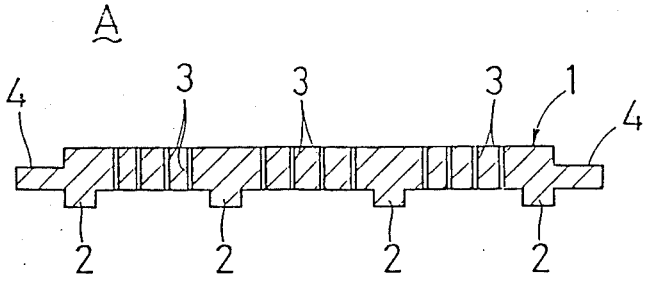
FIG. 1 is a cross section of a floor panel for floating floor embodying the present invention.
Figure 2:
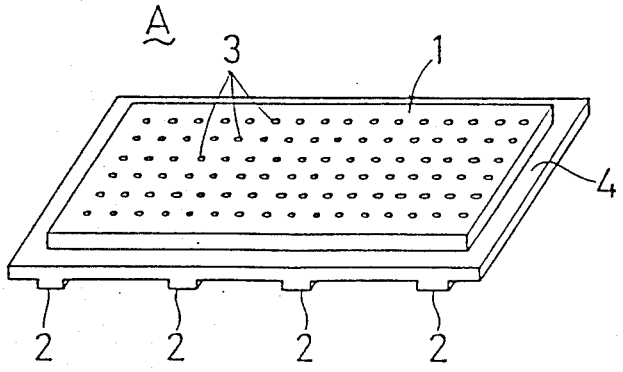
FIG. 2 is a perspective view of the floor panel shown in FIG. 1.

Referring now to FIGS. 1 and 2, there is shown a floor panel A for a floating floor embodying the present invention, which comprises a panel body 1 such as a plywood or a particle board with a 1800 mm length, a 900 mm width and a 50 mm thickness, and several rod-like supporting members 2 with a 900 mm length, a 80 mm width and a 2 to 20 mm thickness. The supporting members 2 are integrally mounted on the underside of the panel body 1 at intervals of 450 mm. The panel body 1 is provided with a plurality of through holes 3 with a diameter of 5 to 20 mm. These through holes 3 are uniformly distributed over the panel body 1 so that an opening area ratio of the through holes to a surface area of the panel body 1 takes a value within the range of 0.1 to 20%.

The supporting members 2 are of the same material with the panel body 1. It is to be noted, however, that the supporting members may be made of a material different from that of the panel body 1 and may be formed in any other configuration such as, for example, in the form of blocks. The supporting members 2 may be attached to the underside of the panel body 1 by bolts or screws to make it possible to adjust their height.

According to the present invention, the through holes 3 have been limited to those having an upper opening diameter of 5 to 20 mm and being uniformly distributed over the floor board such that an opening area ratio of said holes to the surface area of the panel takes a value within range of from 0.1 to 20% for the following reasons. If the opening diameter of the through holes 3 is greater than 20 mm, the presence of through holes 1 gives a feeling of physical disorder to one's feet when the floor panels are directly covered with soft finish floorings. If the opening diameter is less than 5 mm, the air flow does not take place smoothly because of increase in flow resistance. If the opening area ratio of the through holes to the surface area of the panel is less than 0.1%, the resistance to air flow becomes large, and the air does not flow smoothly through the air holes. Thus, it is difficult to reduce the vibration of floor panel effectively. If the opening area ratio is more than 20%, the mechanical strength of the floor panel becomes considerably lowered, resulting in increase in flexural deformation of the panel due to heavy impact forces. If the distribution of through holes is localized, the strength of the floor panel is locally decreased, and the resistance to air flow increases because of increase in pressure of the air present under the floor panel. Thus, it is preferred to distribute the through holes uniformly over the entire surface of the floor panel to prevent it from increase in flow resistance and local decrease in strength.

The relationship between the size and opening area ratio will be explained in more detail, using for an example a floor panel of 1800 by 900 mm in size having through holes with a circular cross section. When the diameter of the through holes is 5 mm, the number of the through holes corresponding to the above opening area ratio will be 90 to 3000. When the diameter of the through holes is 10 mm, the number of the through holes will be 30 to 2000, and when 20 mm, the number of the through holes will be 10 to 1000. It is, however, to be noted that the size of all the through holes to be made in the floor panel A is not necessarily the same, two or more kinds of through holes of different diameter may be made in the floor panels. Also, the through hole 3 may have an upper opening diameter different from its lower opening diameter.

Figure 3:
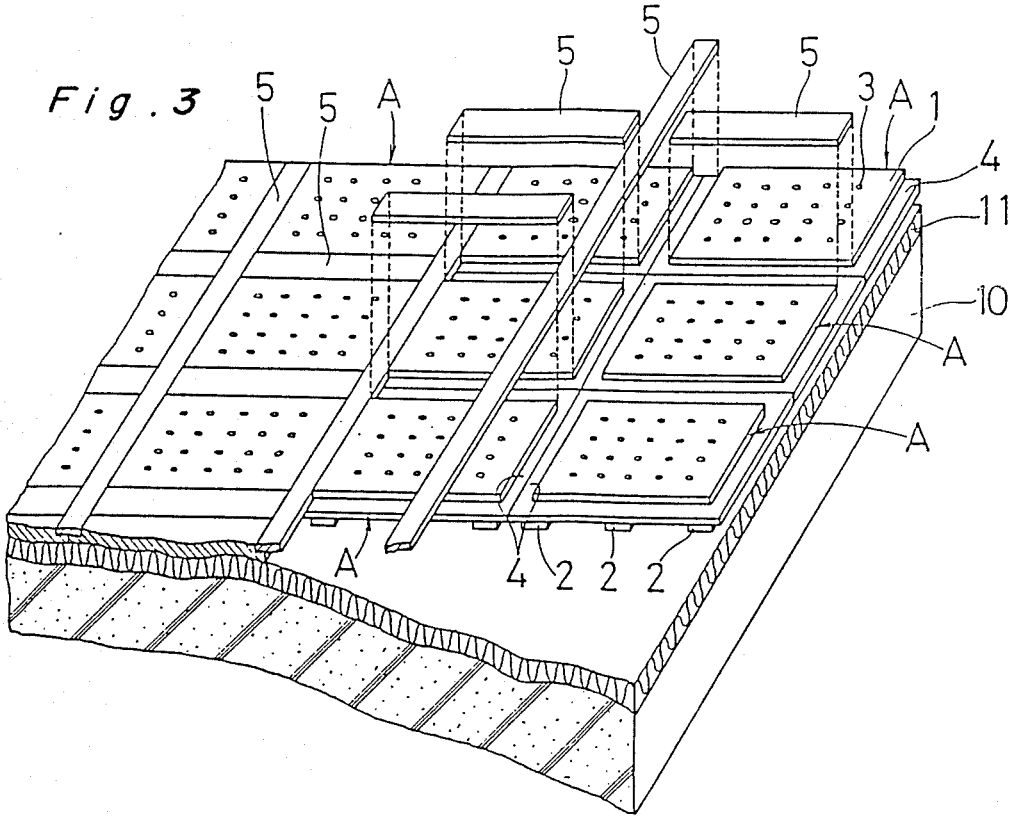
FIG. 3 is a perspective view illustrating construction work of floor panels of FIG. 1.

The panel member 1 is also provided with stepped portions 4 along its upper sides to form channels for combining the adjacent floor panels A. As can be seen from FIG. 3, a floating floor is constructed by first laying buffer members 11 of a porous material such as glass wool mats or lock wool mats on a floor slab 10 or a concrete slab to form a buffer layer, laying floor panels A on the buffer layer, and then inserting connecting members 5 such as tie rods into the channels formed by the stepped portions 4 of the adjacent floor panels A. The provision of stepped portions 4 makes it possible to connect adjacent floor panels A all at once by use of the connecting members 5 without stopping up the through holes 3 and contributes to improve the efficiency of construction work. However, the floor panels A may be connected by the conventional means such as shiplap, slip feather and the like.

Figure 4:
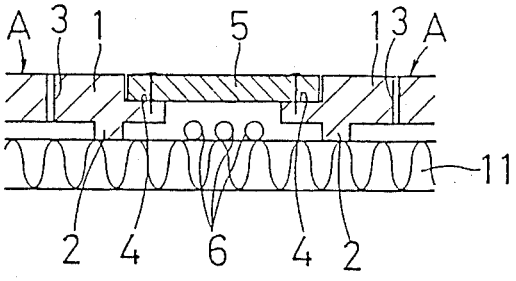
FIG. 4 is a cross section showing a modified construction of a floating floor comprising the floor panels of FIG. 1.

As shown in FIG. 4, the floor panels A may be arranged at proper intervals to form a space for wiring between adjacent panels A. In this case, the floating floor is constructed by laying floor panels A on the buffer layer 11 at proper intervals, carrying out wirings 6 in the space, and mounting the connecting members 5 on the stepped portions 4 of the floor panels A. Thus, the wirings can be concealed by the connecting members 5. When the wiring 6 should be changed, this is done with ease by first removing the connecting members 5 above the wirings 6 and spaces to be wired, changing the wiring 6, and then returning the connecting members 5 in the original places. In this case, there is no need to remove the floor panels A. Thus, it is preferred to use this arrangement from the standpoint of efficiency of construction and wiring work.

Figure 5:
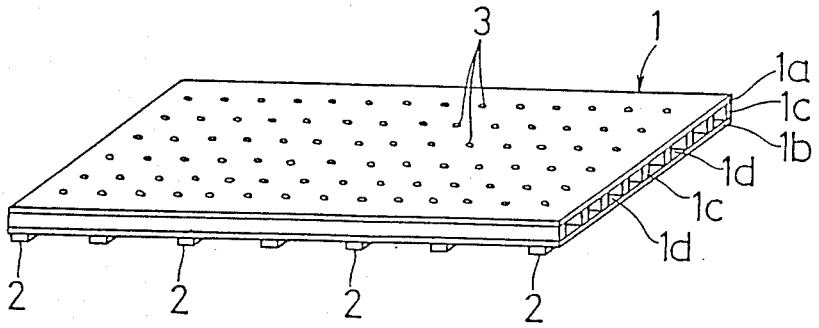
FIG. 5 is a perspective view of an another form of a floor panel for a floating floor embodying the present invention.
Figure 6:
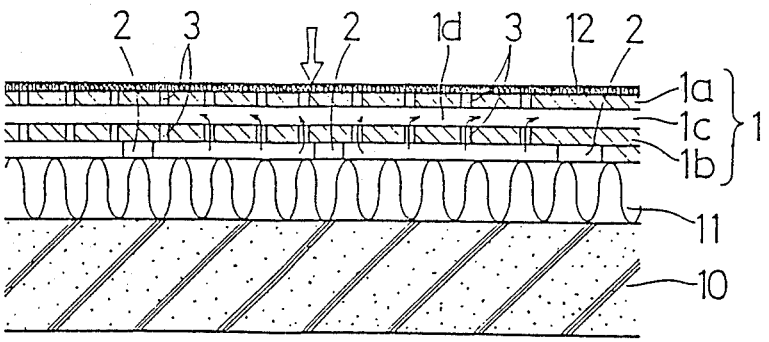
FIG. 6 is a cross section of a floating floor illustrating arrangement of the floor panels shown in FIG. 5.

Referring now to FIG. 5, there is shown another form of a floor panel of the present invention, which comprises a hollow wooden board 1 composed of a pair of face plates 1*a*, 1*b* united by sash bars 1*c* arranged at proper intervals to form cavities 1*d*. The face plates 1*a*, 1*b* are respectively provided with a plurality of through holes 3. Integrally attached to the underside plate 1*b* are supporting members 2. If any impact is applied to the surface of the floor panel as shown in FIG. 6, the air under the lower panel 1*b* flows into the cavities 1*d* while expanding from the air holes 3 of the lower panel 1*b*, and then flows out of the cavities 1*d* through the through holes 3 of the upper plate 1*a*. This floor panel A serves as a sound absorber, thus making it possible to reduce the air pressure in the space between floor panels A and the buffer plate.

Figure 7:
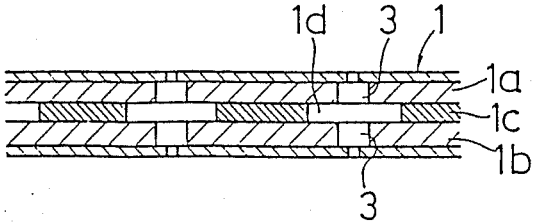
FIGS. 7 to 9 are cross sections of a floor panel embodying the present invention, illustrating several forms of through holes formed in the panel.
Figure 8:
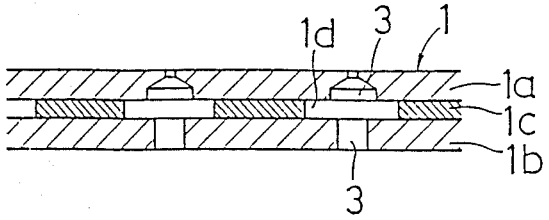
Figure 9:
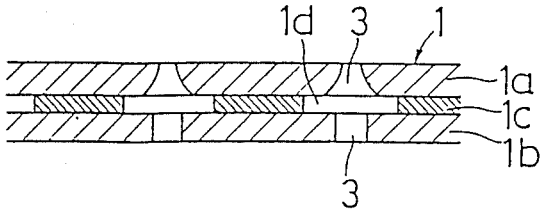

To reduce the resistance to air flow and to improve sound absorbing function of the floor panel A, the floor panel A of FIG. 6 may be modified as shown in FIGS. 7 to 9. In FIG. 7, the sash bar 1*c* is provided with holes 1*d* having a diameter greater than that of the through holes 3. In FIGS. 8 and 9, the through holes 3 are tapered outwardly or so formed that its diameter increases inwards little by little. The cavities 1*d* and through holes 3 constitute sound absorbing holes like a resonator.

Figure 10:
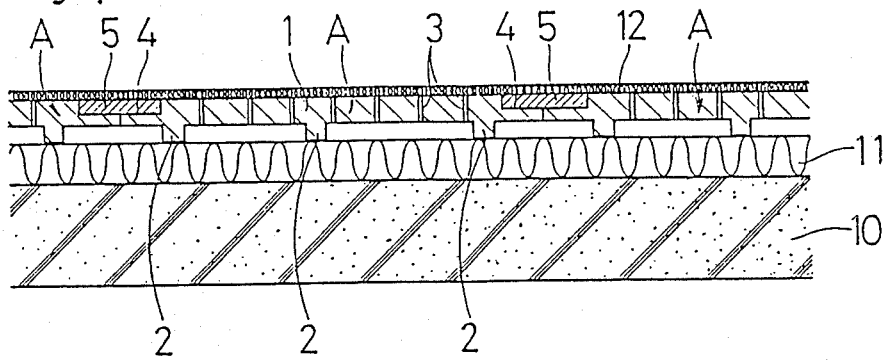
FIG. 10 is a cross section of a floating floor according to the present invention, illustrating construction of the floor.

Referring now to FIG. 10, there is shown a floating floor comprising floor panels A according to the present invention. In this embodiment, the floor panels A are elastically supported by the buffer members 11 such as glass wool mats laid on a floor slab 10 or concrete slab, and directly covered with porous finish floorings 12 of a fibrous material such as carpet.

In the floating floor of FIG. 10, if any heavy impact force is applied to the top of the floating floor, the air in the space formed between the floor panels A and supporting members 2 is compressed by the bending of the floor panel A and, at the same time, the air is released into the upper room through the through holes 3 and porous finish floorings 12. When the floor panel A is deformed reversely by its reaction, the air in the upper room flows into the spaces through the holes 3 of the floor panel A. The outflow and inflow of the air prevent the space from increase in air pressure, resulting in lowering of the force acting of the floor slab 10. On the other hand, the impact force applied to the floor panel A is distributed over the buffer members 11 by the supporting members 2 and then absorbed by the buffer members 2, thus the impact force acting on the floor slab 10 is considerably weakened. These phenomena reduce not only the impact force transmitted to the slab 10 by the air and floor panel, but also the reaction force due to the compressed air transmitted to the floor panel A, thus making it possible to reduce the vibration of the floor panels A and the slab 10, which in turn makes it possible to reduce transmission of the floor impact sounds to the room located directly below.

Figure 11:
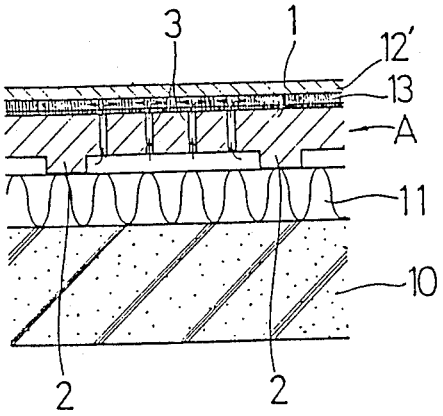
FIG. 11 is a cross section similar to FIG. 10, illustrating another form of a construction of the floating floor.

FIG. 11 shows another embodiment of the floating floor having a construction similar to that of FIG. 10 except for that the floor panels A are covered by porous layer 13 of felt, on which finish floorings 12′ such as cushion floorings or vinyl tiles. In the embodiment, if any impact force is applied to the floor, the air under the floor panel A is compressed by bending of the floor panel A and then forced out through the through holes 3 into the porous layer 13.

Figure 12:
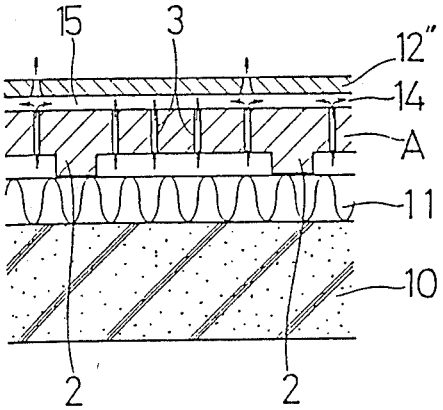
FIG. 12 is a cross section similar to FIG. 10, illustrating another form of a floating floor construction.

FIG. 12 shows another form of the floating floor. In this embodiment, spacers 14 such as joists are arranged at proper spaces and wooden finish floorings 12″ are laid on the spacers to form airways 15 between the floor panels A and finish floorings 12″. In the embodiment, if any impact force is applied to the floor, the air under the floor panel A is compressed by bending of the floor panel A and then forced out through the holes 3 into the airways 15. It is preferred to form plural air holes in the finish floorings 12″ to allow the air in the airway to flow into the upper room as shown in FIG. 12.

EXAMPLE 1

There was prepared floor panels by first making 180 holes of a 12 mm diameter in a solid particle board of a 1800 mm length, a 900 mm width and a 24 mm thickness so that the holes are uniformly distributed over the panel and have a opening area ratio of 1.2%, bonding rod-like supporting members of a 800 mm length, a 50 mm width and a 12 mm thickness to the underside of the board in parallel at intervals of 360 mm, and finally cutting the upper side of the board along its periphery to form stepped portions of a 60 mm width and a 12 mm depth.

EXAMPLE 2

Using two plywoods of 1800×900×12 mm as face plates, and sash bars of 1800×20×12 mm, there was prepared a hollow panel by arranging the sash bars between the plywoods at intervals of 40 mm and uniting them with glue. The upper and lower face plates were drilled to form 100 holes of a 12 mm diameter (opening area ratio: 0.7%) having the same axle. After fixing supporting members on the underside of the hollow panel, the upper side of the panel was cut along its periphery to form stepped portions in the same manner as in Example 1.

To evaluate the impact sound insulating properties of the thus prepared floor panels, these floor panels were laid side by side on glass wool mats of density 64 kg/m$^3$ and a thickness of 50 mm arranged on a concrete slab of thickness 150 mm, and then covered with a carpet or wooden finish floorings. The wooden finish floor was prepared by first arranging joists of a 12 mm thickness and a 80 mm width on the floor panel at pitches of 450 mm, and then laying the wooden finish floorings on the joists.

Figure 13:
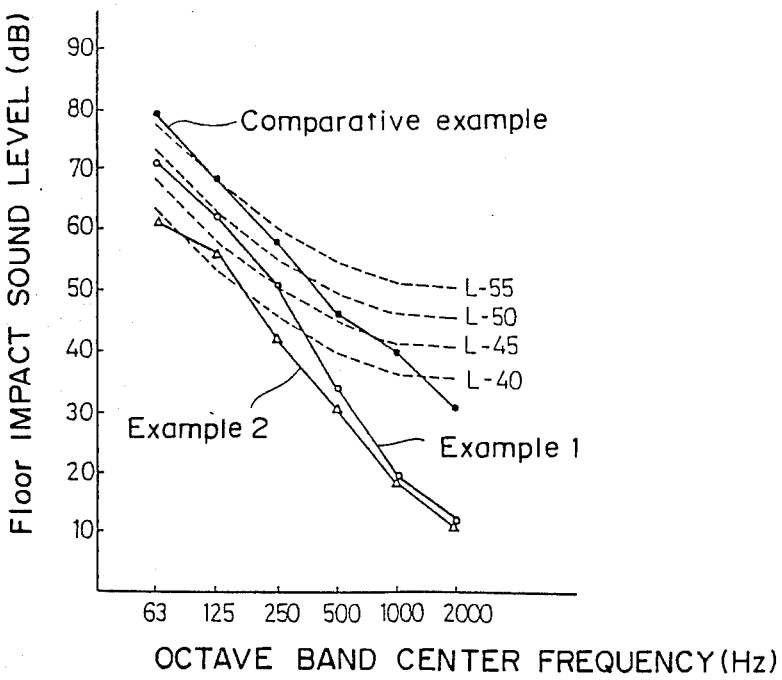
FIG. 13 is a graph showing the impact sound insulating characteristics of the floating floor with a finish floor of a carpet.

Measurement of floor impact sound level was carried out by a method for field measurement of floor impact sound level, specified in JIS A 1418, using a heavy floor impact sound generating machine. Results are plotted in FIGS. 13 and 14 together with standards for floor impact sound insulation properties. FIG. 13 shows results for the floating floor with carpet finishing, while the results for the floating floor with wooden floor finishing are shown in FIG. 14.

For comparison, there was prepared a floating floor by arranging joists of 50×50 mm in cross section on the glass wool mats, laying a particle board with a thickness of 25 mm, and then covering the board with the same carpet or wooden finish flooring as the above. Results for the comparative floating floor are also shown in FIGS. 13 and 14.

Figure 14:
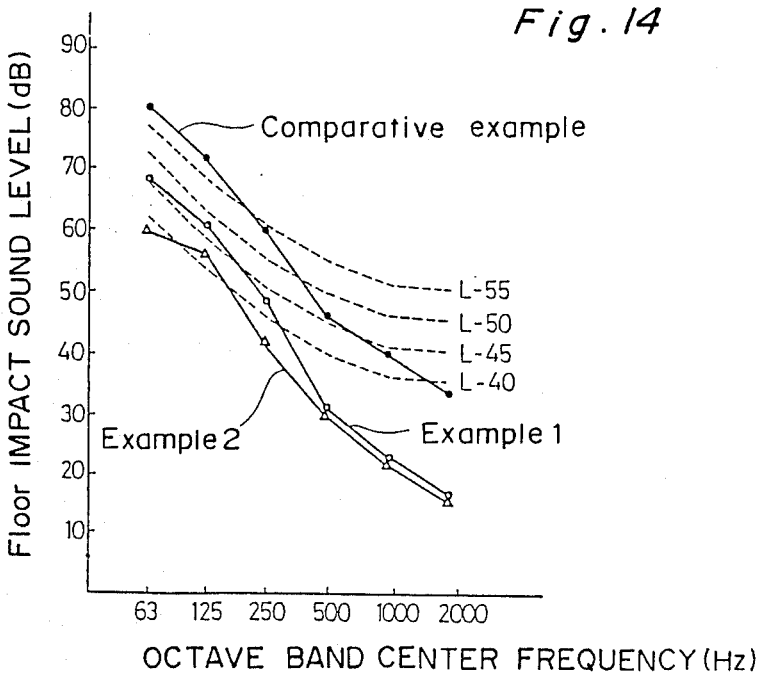
FIG. 14 is a graph showing the impact sound insulating characteristics of a floating floor embodying the present invention with a wooden finish floor.

From the results shown in FIGS. 13 and 14, it will be seen that the floating floor according to the present invention makes it possible to reduce the impact sound transmission through the floor, in particularly, at frequencies of the order of 63 Hz. Also, the floating floor of the present invention has excellent impact sound insulating performance which satisfies the sound insulation class $L_H$-40 or $L_H$-50 specified in JIS A 1419.

What I claim is:

1. A floor panel for a floating floor, said floating floor having a plurality of said floor panels elastically supported by buffer members laid on a floor slab, said floor panel comprising a hollow panel and plural supporting means mounted on said hollow panel, said hollow panel having upper and lower face panels spaced by sash bars arranged between them at proper intervals to form elongated cavities, each of said cavities being opened at opposite ends, said upper and lower face panels being provided with a plurality of through holes distributed uniformly over the face panel, said holes of said upper face panel being respectively aligned with those of the lower face panel and each having an upper opening diameter ranging from 5 to 20 milimeters, a ratio of whole upper opening area of said holes to an upper surface area of said floor panel being within the range of 0.1 to 20%, said supporting means being mounted on said lower face panel at proper intervals to form space between said floor panel and buffer members when said floor panel is arranged on said buffer members.

2. A floor panel as claimed in claim 1, wherein the through holes of said upper face panel are tapered so that its upper opening diameter is smaller than its lower opening diameter.

3. A floor panel as claimed in claim 1, wherein said sash bars are provided with holes therethrough.

4. A floor panel according to claim 5 wherein the floor panel is provided with a steped portion along the periphery of upper side.

* * * * *